US005534164A

United States Patent [19]

Guglielmi

[11] Patent Number: 5,534,164

[45] Date of Patent: Jul. 9, 1996

[54] NON-TOXIC, ENVIRONMENTALLY BENIGN FIRE EXTINGUISHANTS

[76] Inventor: Elio Guglielmi, 304 - 700 West Pender St., Vancouver, British Columbia, Canada, V6C 1G8

[21] Appl. No.: 302,709

[22] PCT Filed: Mar. 10, 1992

[86] PCT No.: PCT/CA92/00104

§ 371 Date: Nov. 18, 1994

§ 102(e) Date: Nov. 18, 1994

[87] PCT Pub. No.: WO93/17758

PCT Pub. Date: Sep. 16, 1993

[51] Int. Cl.[6] ..... A62D 1/08

[52] U.S. Cl. ..... 252/8; 252/2; 169/46

[58] Field of Search ..... 252/2, 8, 67, 68, 252/69, 365; 169/46, 47

[56] References Cited

U.S. PATENT DOCUMENTS

| | | | |
|---|---|---|---|
| 2,021,981 | 11/1935 | Bichowsky | 23/12 |
| 3,879,297 | 4/1975 | Langville et al. | 252/8 |
| 4,826,610 | 5/1989 | Thacker | 252/8 |
| 4,954,271 | 9/1990 | Green | 252/8 |
| 5,055,208 | 10/1991 | Stewart et al. | 252/8 |
| 5,141,654 | 8/1992 | Fernandez | 252/8 |
| 5,393,438 | 2/1995 | Fernandez | 252/8 |

FOREIGN PATENT DOCUMENTS

| | | |
|---|---|---|
| 1603867 | 5/1978 | United Kingdom . |
| 2185394 | 1/1987 | United Kingdom . |
| 9112853 | 9/1991 | WIPO . |

*Primary Examiner*—Sharon Gibson
*Assistant Examiner*—Joseph D. Anthony
*Attorney, Agent, or Firm*—Oyen Wiggs Green & Mutala

[57] ABSTRACT

Flooding fire extinguishing agents which are non-toxic and environmentally safe in both natural form and in degraded form which may occur as a result of exposure to fire are disclosed. The flooding fire extinguishing agents are rich in low boiling unsaturated chlorofluorocarbon compounds and have low liquid viscosities.

5 Claims, No Drawings

NON-TOXIC, ENVIRONMENTALLY BENIGN FIRE EXTINGUISHANTS

FIELD OF THE INVENTION

This invention pertains to fire extinguishing agents which are non-toxic and environmentally safe in both natural form and in degraded forms which may occur as a result of exposure to fire.

DESCRIPTION OF THE PRIOR ART

U.S. Pat. No. 4,954,271, issued Sep. 4, 1990, Raymond W. Green, discloses and protects environmentally amicable fire extinguishing agents comprising in combination: (a) more than 50% by weight of a fluorochlorocarbon selected from the group consisting of: 1,1-dichloro-2,2,2-trifluoroethane, and 1,2-dichloro-2,2 -difluoroethane; (b) less than 48% by weight of a fluorocarbon selected from the group consisting of: chlorodifluoromethane, 1-chloro-1,2,2,2-tetrafluoroethane, pentafluoroethane, 1,2,2,2-tetrafluoroethane; and (c) a substance selected from the group consisting of terpenes: citral, citronellal, citronellol, limonene, dipentene, menthol, terpinene, terpinolene, sylvestrene, sabinene, methadiene, zingiberene, ocimene, myrcene, α-pinene, β-pinene, turpentine, camphor, phytol, vitamin A, abietic acid, squalene, lanosterol, saponin, oleanolic acid, lycopene, β-carotene, lutein, α-terpineol, and p-cymeme; and unsaturated oils; oleic acid, linoleic acid, linolenic acid, eleosearic acid, lincanic acid, ricinoleic acid, palmitoleic acid, petroselenic acid, vaccenic acid, and erucic acid, in the range of from 2 to 10% by weight.

U.S. Pat. No. 4,826,610, issued May 2, 1989, Derek A. Thacker, discloses a firefighting composition comprising one or more of Halons 11, 12, 113 and 114 together with 1% to 14% by weight of an extinguishant base including a sesquiterpene and one or more essential oils. Solvents and dispersing agents may also be provided. This composition is suited for stream type firefighting situations. The formulation is not particularly ozone friendly.

G.B. Patent No. 1,603,867, Derek A. Thacker, Dec. 2, 1981, discloses a fire extinguisher formulation comprising trichlorofluoromethane (Halocarbon Number 11) and an additive comprised of a mono-terpene. The additive can include an essential oil such as citrus oil or pinene. Dichlorofluoromethane (Halocarbon Number 12) can be included in the formulation.

SUMMARY OF THE INVENTION

A fire extinguishing mixture of the following compounds:

(a) 90 to 99.9% wt. of one or more halocarbons of the formula:

$$C_WH_XCl_YF_Z$$

wherein W is 1, 2, 3 or 4, X is any one of 0 to 9, Y is any one of 0 to 9 and Z is any one of 1 to 10, provided when W is 1, X is 0 to 2, Y is 0 to 2, and Z is 1 to 3, the total to add up to 4; when W is 2, X is 0 to 4, Y is 1 to 5, and Z is 1 to 5, the total to add up to 6; when W is 3, X is 0 to 6, Y is 0 to 7, and Z is 1 to 8, the total to add up to 8; and when W is 4, X is 0 to 8, Y is 0 to 9, and Z is 1 to 10, the total to add up to 10; and (b) 0.1 to 10% wt. of one or more detoxifying substances selected from the group consisting of:

| | | |
|---|---|---|
| citral | citronellal | citronellol |
| limonene | dipentene | menthol |
| terpinene | terpinolene | sylvestrene |
| sabinene | menthadiene | zingiberene |
| ocimene | myrcene | alpha-pinene |
| beta-pinene | turpentine | camphor |
| phytol | vitamin A | abietic acid |
| squalene | lanosterol | saponin |
| oleanolic acid | lycopene | beta-carotene |
| lutein | alpha-terpineol | para-cymene |
| oleic acid | linoleic acid | linolenic acid |
| eleostearic acid | lincanic acid | ricinoleic acid |
| palmitoleic acid | petroselenic acid | vaccenic acid |
| erucic acid | ethene | propene |
| butene | isopropene | pentene |
| isopentene | trimethylethene | tetramethylethene |
| butadiene | 2-methylbutadiene | pentadiene |
| isobutylene | | |

the mixture having a boiling point of about −85° C. to about 200° C., a molecular weight in the range of 70 to 400, and a vapour pressure of about MPa 0.1 to about 5.

A fire fighting mixture of the formula:

(a) 90% to 99.9% wt. of a chlorofluorocarbon or fluorocarbon selected from the group consisting of:

| | |
|---|---|
| hydrochlorofluorocarbon.13 - | chlorotrifluoromethane |
| hydrochlorofluorocarbon.21 - | dichlorofluoromethane |
| hydrochlorofluorocarbon.22 - | chlorodifluoromethane |
| hydrochlorofluorocarbon.31 - | chlorofluoromethane |
| hydrochlorofluorocarbon.121 - | 1,1,2,2-tetrachloro-1-fluoroethane |
| hydrochlorofluorocarbon.122 - | 1,1,2-trichloro-2,2-difluoroethane |
| hydrochlorofluorocarbon.123 - | 2,2-dichloro-1,1,1-trifluoroethane |
| - | 1,2-dichloro-1,1,2-trifluoroethane |
| hydrochlorofluorocarbon.124 - | 2-chloro-1,1,1,2-tetrafluoroethane |
| - | 1-chloro-1,1,2,2-tetrafluoroethane |
| hydrochlorofluorocarbon 125 - | pentafluoroethane |
| hydrochlorofluorocarbon.131 - | |
| hydrochlorofluorocarbon.132 - | 1,2-dichloro-1,1-difluoroethane |
| hydrochlorofluorocarbon.133 - | 2-chloro-1,1,1-trifluorethane |
| hydrochlorofluorocarbon.134a - | 1,1,1,2-tetrafluoroethane |
| hydrochlorofluorocarbon.141 - | 1,2-dichloro-1-fluoroethane |
| - | 1,1-dichloro-1-fluoroethane |
| | hexafluoropropane |
| hydrochlorofluorocarbon.142 - | 1-chloro-1,1-difluoroethane |
| hydrochlorofluorocarbon.221 - | 2-fluorohexachloropropane |
| hydrochlorofluorocarbon.222 - | 1,1-difluoro-1,2,2,3,3-pentachloropropane |
| hydrochlorofluorocarbon.223 - | |
| hydrochlorofluorocarbon.224 - | |
| hydrochlorofluorocarbon.225 - | 3,3-dichloro-1,1,1,2,2-pentafluoropropane |
| - | 1,3-dichloro-1,1,2,2,3-pentafluoropropane |
| hydrochlorofluorocarbon.226 - | |
| hydrochlorofluorocarbon.231 - | |
| hydrochlorofluorocarbon.232 - | |
| hydrochlorofluorocarbon.233 - | |
| hydrochlorofluorocarbon.234 - | |
| hydrochlorofluorocarbon.235 - | |
| hydrochlorofluorocarbon.241 - | |
| hydrochlorofluorocarbon.242 - | 1,1,1-trichloro-2,2-difluoropropane |

-continued

| | |
|---|---|
| hydrochlorofluorocarbon.243 - | |
| hydrochlorofluorocarbon.244 - | |
| hydrochlorofluorocarbon.251 - | |
| hydrochlorofluorocarbon.252 - | |
| hydrochlorofluorocarbon.253 - | 2-chloro-1,1,1-trifluoropropane |
| hydrochlorofluorocarbon.261 - | 1,2-dichloro-2-fluoropropane |
| hydrochlorofluorocarbon.262 - | |
| hydrochlorofluorocarbon.271 - | |

(b) 0 to 10% of one or more detoxifying substance selected from the group consisting of:

| | | |
|---|---|---|
| citral | citronellal | citronellol |
| limonene | dipentene | menthol |
| terpinene | terpinolene | sylvestrene |
| sabinene | menthadiene | zingiberene |
| ocimene | myrcene | alpha-pinene |
| beta-pinene | turpentine | camphor |
| phytol | vitamin A | abietic acid |
| squalene | lanosterol | saponin |
| oleanolic acid | lycopene | beta-carotene |
| lutein | alpha-terpineol | para-cymene |
| oleic acid | linoleic acid | linolenic acid |
| eleostearic acid | lincanic acid | ricinoleic acid |
| palmitoleic acid | petroselenic acid | vaccenic acid |
| erucic acid | ethene | propene |
| butene | isopropene | pentene |
| isopentene | trimethylethene | tetramethylethene |
| butadiene | 2-methylbutadiene | pentadiene |
| isobutylene | | |

A fire extinguishing mixture for use in a flooding technique in an enclosed volume comprising:

(a) more than 50 percent by weight of a substance selected from the group consisting of:

dichlorodifluoromethane,
1,2-dichlorotetrafluoroethane,
chlorodifluoromethane,
1-chloro-1,2,2,2-tetrafluoroethane,
1,1-dichloro-2,2,2-trifluoroethane,
1,2,2,2-tetrafluoroethane,
pentafluroethane;

(b) less than 48 percent by weight of a substance selected from the group consisting of:

trichlorofluoromethane,
1,1-dichlorotetrafluoroethane,
1,2-dichloro-2,2-difluoroethane; and c) between 0.25 and 10 percent by weight of a detoxifying substance selected from the group consisting of:

| | | |
|---|---|---|
| citral | citronellal | citronellol |
| limonene | dipentene | menthol |
| terpinene | terpinolene | sylvestrene |
| sabinene | menthadiene | zingiberene |
| ocimene | myrcene | alpha-pinene |
| beta-pinene | turpentine | camphor |
| phytol | vitamin A | abietic acid |
| squalene | lanosterol | saponin |
| oleanolic acid | lycopene | beta-carotene |
| lutein | alpha-terpineol | para-cymene |
| oleic acid | linoleic acid | linolenic acid |
| eleostearic acid | lincanic acid | ricinoleic acid |
| palmitoleic acid | petroselenic acid | vaccenic acid |
| erucic acid | ethene | propene |
| butene | isopropene | pentene |
| isopentene | trimethylethene | tetramethylethene |
| butadiene | 2-methylbutadiene | pentadiene |

-continued

| | |
|---|---|
| isopropenyl-1-methyl-cyclohexene | isobutylene |

The initial boiling point of the mixture can be between −80° C. and −10° C. The fluid viscosity of the mixture can be below 1.0 centipoise in the range between the initial boiling point of the mixture and 25° C.

A fire extinguishing mixture for use in a flooding technique in an enclosed volume comprising:

(a) at least 50 percent by weight of a substance selected from the group consisting of:

chlorodifluoromethane,
dichlorodifluoromethane;

(b) less than 48 percent by weight of a substance selected from the group consisting of:

1-chloro-1,2,2,2-tetrafluoroethane,
1,2-dichlorotetrafluoroethane,
trichlorofluoromethane,
1,1-dichloro-2,2,2-trifluoroethane; and (c) between 2 and 4 percent by weight of a substance selected from the group consisting of:

dipentene, and
limonene.

A specific fire extinguishing mixture can consist essentially of about 96 percent by weight of chlorodifluoromethane, and about 4 percent by weight of limonene. Another specific fire extinguishing mixture can consist essentially of about 85 percent by weight of chlorodifluoromethane, about 11.5 percent by weight of 1-chloro- 1,2,2,2-tetrafluoroethane, and about 3.5 percent by weight of dipentene.

A further embodiment of fire extinguishing mixture can consist essentially of about 65 percent by weight of dichlorodifluoromethane, about 15.5 percent by weight of 1,2-dichlorotetrafluoroethane, about 15.5 percent by weight of trichlorofluoromethane, and about 4 percent by weight of limonene. A further version of fire extinguishing mixture can consist essentially of about 65 percent by weight of dichlorodifluoromethane, about 15.5 percent of 1,2-dichlorotetrafluoroethane, about 15.5 percent by weight of trichlorofluoromethane, and about 4 percent by weight of dipentene.

A variation embodiment of the fire extinguishing mixture can consist essentially of about 75 percent by weight of chlorodifluoromethane, about 11.75 percent by weight of 1,1-dichloro-2,2,2-trifluoroethane, about 9.5 percent by weight of 1-chloro-1,2,2,2-tetrafluoroethane, and about 3.75 percent by weight of limonene.

An alternative embodiment comprises about 4.75% wt. of 2,2-dichloro-1,1,1-trifluoroethane, about 82% wt. of chlorodifluoromethane, about 9.5% wt. of 2-chloro-1,1,1,2-tetrafluoroethane and about 3.75% wt. isopropenyl-1-methyl cyclohexene.

The initial boiling point of the mixture preferably can be between −80° C. and −10° C. The fluid viscosity of the mixture can be below 1.0 centipoise between the initial boiling point of the mixture and 25° C.

A fire extinguishing mixture of the formula:

(a) about 1% wt. of 2,2-dichloro-1,1,1-trifluoroethane or 1,2-dichloro-1,1,2-trifluoroethane;

(b) about 9.5% wt. of 2-chloro-1,1,1,2-tetrafluoroethane or 1-chloro-1,1,2,2-tetrafluoroethane;

(c) about 79.5 to 88.5% wt. of chlorodifluoromethane; and (d) about 1 to 10% wt. of isobutylene.

A fire extinguishing mixture of the formula:

(a) about 4 to 45% wt. of 2-chloro-1,1,1,2-tetrafluoroethane or 1-chloro-1,1,2,2-tetrafluoroethane;

(b) about 50 to 90% wt. of pentafluoroethane; and (c) about 0 to 10% wt. of isobutylene.

DESCRIPTION OF THE PREFERRED EMBODIMENT

In this disclosure, the word "fire" refers explicitly to standardized testing fires as defined by authoritative regulatory bodies having jurisdiction in the areas of fire control, fire prevention, and fire fighting.

We have invented a family of new chlorofluorocarbon and fluorocarbon fire extinguishing agents that cause minimum damage to the ozone layer of the earth. The agents contain no bromofluorocarbons which have been discovered to have serious ozone damaging effect. Also, since chlorine is being discovered to be potentially harmful to the ozone layer, chlorine content of the chlorofluorocarbons has been minimized.

A standard regulatory test for evaluating flooding type fire extinguishants uses a test chamber measuring 0.5×3×3 meters containing five pot fires distributed evenly in the space. The extinguishant to be tested is pumped through a pipe system measuring 3 meters. A kilogram of extinguishant is pumped through the pipe system and the time taken to extinguish the fires is measured.

When a flooding or inerting fire extinguishing technique is to be used, that is, where the extinguishant is released into an enclosed volume containing a fire, we have discovered that fires of this type are best extinguished using mixtures as follows:

(a) more than 50 percent by weight of the following seven compounds, singly or in combination:

dichlorodifluoromethane,
1,2-dichlorotetrafluoroethane,
chlorodifluoromethane,
1-chloro-1,2,2,2-tetrafluoroethane,
1,2,2,2-tetrafluoroethane,
1,1-dichloro-2,2,2-trifluoroethane,
pentafluroethane;

(b) less than 48 percent by weight of the following three compounds, singly or in combination:

trichlorofluoromethane,
1,1-dichlorotetrafluoroethane,
1,2-dichloro-2,2-difluoroethane; and (c) between 0.25 and 10 percent by weight of any one or more of the following fifty-one alkenes, terpenes and unsaturated oils:

| | | |
|---|---|---|
| citral | citronellal | citronellol |
| limonene | dipentene | menthol |
| terpinene | terpinolene | sylvestrene |
| sabinene | menthadiene | zingiberene |
| ocimene | myrcene | alpha-pinene |
| beta-pinene | turpentine | camphor |
| phytol | vitamin A | abietic acid |
| squalene | lanosterol | saponin |
| oleanolic acid | lycopene | beta-carotene |
| lutein | alpha-terpineol | para-cymene |
| oleic acid | linoleic acid | linolenic acid |
| eleostearic acid | lincanic acid | ricinoleic acid |
| palmitoleic acid | petroselenic acid | vaccenic acid |
| erucic acid | ethene | propene |
| butene | isopropene | pentene |

-continued

| | | |
|---|---|---|
| isopentene | trimethylethene | tetramethylethene |
| butadiene | 2-methylbutadiene | pentadiene |
| isobutylene | | |

The precise choice of agents and compositions will be governed by a balance of cost, factors governing fluid and vapor flow, factors governing fluid and vapor physical characteristics, and the configuration of the extinguishant flooding system needed to protect the intended volume(s).

It has been discovered that for extinguishing fires in enclosed volumes by flooding or inerting techniques, it is critical that the fluid viscosity and initial boiling points of the fire extinguishant are low. A number of other criteria are also important. The mixtures we have invented that are suitable for flooding or inerting fire extinguishing agents have the following characteristics and attributes:

1. The class of fire flooding mixtures according to the invention must be richer in lower boiling compounds, and not exhibit much cohesion. The flooding class described will rapidly vaporize and flood the intended volume to the concentration of extinguishant required to smother or inert the gaseous phase and prevent or extinguish an included fire.
2. The lower boiling points exhibited by this class of flooding mixtures, can permit the list of detoxifying agents to include low boiling alkenes which cannot be successfully used with streaming extinguishants.
3. The relative quantities of detoxifying alkene, terpene, and unsaturated oil in the flooding mixtures described can be reduced because the flooding technique uses a fixed but larger quantity of extinguishing mixture than is required for streaming type agents.
4. The low boiling fluorochlorocarbons listed in list (a) produce lower quantities of toxic halogens and hydrogen halides upon decomposition than do the higher boiling fluorochlorocarbons in list (b). This permits lesser quantities of detoxifying agents to be used.
5. When the detoxifying agents are eliminated completely from the fire extinguishing mixtures, we have found that fire extinguishing is less efficient than when the detoxifying compounds are included. Also, dangerous levels of toxic halogen and hydrogen halides are produced when the extinguishant mixture is decomposed by the heat of the fire.
6. The physical characteristics of a flooding mixture should have a boiling range between −80° C. and −10° C. It should also have a liquid viscosity less than 1.0 centipoise in the temperature range from the initial boiling point of the mixture to approximately 25° C.

EXAMPLE 1

In one particular test, a test chamber measuring 0.5×3×3 meters and containing five standard pot fires was flooded pumping a pipe system about 3 meters in total length. The pot fires were inerted in less than 10 seconds by using 1 kg of a mixture consisting of 96 percent by weight of chlorodifluoromethane and 4 percent by weight of limonene through the pipe. This mixture had an initial boiling point of −40.5° C. and a liquid viscosity of 0.21 centipoise at 25° C.

EXAMPLE 2

In another evaluation using the same test chamber as in Example 1, the five pot fires were inerted in less than 10 seconds using 1 kg of a mixture consisting of 85 percent by weight of chlorodifluoromethane, 11.5 percent by weight of 1-chloro-1,2,2,2-tetrafluoroethane, and 3.5 percent by weight of dipentene.

EXAMPLE 3

In a third test using the same test chamber as in Example 1, the five pot fires were inerted in less than 10 seconds using 1 kg of a mixture consisting of 65 percent by weight of chlorodifluoromethane, 15.5 percent by weight of 1,2-dichlorotetrafluoroethane, 15.5 percent by weight of trichlorofluoromethane, and 4 percent by weight of limonene. This mixture had an initial boiling point of −27° C. and a fluid viscosity of 0.28 centipoise at 25° C.

EXAMPLE 4

In a fourth application using the same test chamber as in Example 1, the five pot fires were inerted in less than 10 seconds using 1 kg of a mixture consisting of 65 percent by weight of dichlorodifluoromethane, 15.5 percent by weight of 1,2-dichlorotetrafluoroethane, 15.5 percent by weight of trichlorofluoromethane and 4 percent by weight of limonene. This mixture exhibited an initial boiling point of −13° C. and a viscosity of 0.36 centipoise at 25° C.

EXAMPLE 5

In a fifth test using the same test chamber as in Example 1, the five pot fires were inerted in less than 10 seconds using 1 kg of a mixture consisting of about 65 percent by weight of dichlorodifluoromethane, about 15.5 percent of 1,2-dichlorotetrafluoroethane, about 15.5 percent by weight of trichlorofluoromethane, and about 4 percent by weight of dipentene.

EXAMPLE 6

In a sixth evaluation using the same test chamber as in Example 1, the five pot fires were inerted in less than 10 seconds using 1 kg of a mixture consisting of about 75 percent by weight of chlorodifluoromethane, about 11.75 percent by weight of 1,1-dichloro-2,2,2-trifluoroethane, about 9.5 percent by weight of 1-chloro-1,2,2,2-tetrafluoroethane, and about 3.75 percent by weight of limonene.

These examples vividly demonstrate the key role that low fluid viscosity and low boiling point plays in parameterizing the mixtures required to achieve optimum volume of fire extinguishing performance. The goal is to achieve mixtures having an initial boiling point approximating −60° C. and a fluid viscosity approximating 0.15 centipoise at 25° C.

The following ozone benign formulation has been invented to replace Halon 1301, which is a well known and widely used chlorofluorocarbon flooding extinguishant:

| | |
|---|---|
| 2,2 dichloro-1,1,1-trifluoroethane - | 4.75% wt.; |
| chlorodifluoromethane - | 82% wt.; |
| 2 chloro 1,1,1,2-tetrafluoroethane - | 9.5% wt.; |
| isopropenyl-1-methyl cyclohexene - | 3.75% wt. |

The properties of this formulation (called NAF S-III) compared to Halon 1301 are shown in Table 1.

TABLE 1

| Physical Properties | Halon 1301 | NAF S-III |
|---|---|---|
| Ozone depletion potential | 10.00 | 0.044 |
| Global warming potential | .80 | .31 |
| Lifetime | 107 years | 7 years |
| Molecular weight | 148.95 | 92.9 |
| Boiling point at 1 atm. °C. | −57.75 | −38.3 |
| Critical temperaturre °C. | 67 | 125 |
| Critical pressure (psia) (760 mmHg = 14.7 psia) | 67.0 | 66.5 |
| Critical density (kg/m$^3$) | 745 | 580 |
| Density of liquid at 25° (g/ml) | 1.57 | 1.20 |
| Specific heat of liquid at 25° C. [J/(kg. °C.)] | 870 | 1250 |
| Heat of vaporization at boiling point (kJ/kg) | 118.8 | 227 |
| viscosity of liquid at 25° C. | 0.159 centipoise | 0.21 centipoise |
| Acute toxicity ($ALC_{50}$ rats: 4 hrs-ppm) | 400–800,000* | 290,000 |
| Solubility in water at 25° C. | 0.03 weight % | 0.0835 weight % |

*estimated values

I claim:

1. A fire extinguishing mixture comprising:

(a) about 1% wt. of 2,2-dichloro-1,1,1-trifluoroethane or 1,2-dichloro-1,1,2-trifluoroethane;

(b) about 9.5% wt. of 2-chloro-1,1,1,2-tetrafluoroethane or 1-chloro-1,1,2,2-tetrafluoroethane;

(c) about 79.5 to 88.5% wt. of chlorodifluoromethane; and (d) about 1 to 10% wt. of isobutylene, said fire extinguishing mixture being non-toxic and environmentally benign in both natural form and degraded form on exposure to fire.

2. A fire extinguishing mixture comprising about 4.75% wt. of 2,2-dichloro-1,1,1-trifluoroethane, about 82% wt. of chlorodifluoromethane, about 9.5% wt. of 2-chloro-1,1,1,2-tetrafluoroethane and about 3.75% wt. 4-isopropenyl-1-methyl cyclohexene, said fire extinguishing mixture being non-toxic and environmentally benign in both natural form and degraded form on exposure to fire.

3. A fire extinguishing mixture consisting of about 96% by weight of chlorodifluoromethane, and about 4% by weight of limonene, said fire extinguishing mixture being non-toxic and environmentally benign in both natural form and degraded form on exposure to fire.

4. A fire extinguishing mixture consisting of about 85% by weight of chlorodifluoromethane, about 11.5% by weight of 1-chloro-1,2,2,2-tetrafluoroethane, and about 3.5% by weight of dipentene, said fire extinguishing mixture being non-toxic and environmentally benign in both natural form and degraded form on exposure to fire.

5. A fire extinguishing mixture consisting of about 75% by weight of chlorodifluoromethane, about 11.75% by weight of 1,1-dichloro-2,2,2-trifluoroethane, about 9.5% by weight of 1-chloro-1,2,2,2-tetrafluoroethane, and about 3.75% by weight of limonene, said fire extinguishing mixture being non-toxic and environmentally benign in both natural form and degraded form on exposure to fire.

* * * * *